US005177907A

United States Patent [19]

Rothe et al.

[11] Patent Number: 5,177,907

[45] Date of Patent: Jan. 12, 1993

[54] PLASTIC LENS BLOCK WITH RIBS

[75] Inventors: Charles T. Rothe, Manitou; Craig Buckner, Madisonville, both of Ky.

[73] Assignee: Summitt Molding & Engineering, Inc., Madisonville, Ky.

[21] Appl. No.: 790,510

[22] Filed: Nov. 12, 1991

[51] Int. Cl.[5] ..... B24B 41/06; B24B 13/005

[52] U.S. Cl. ..... 51/216 LP; 51/284 R

[58] Field of Search ..... 51/216 R, 216 LP, 277, 51/284 R, 229, 240 GB, 284 E

[56] References Cited

U.S. PATENT DOCUMENTS

| | | | |
|---|---|---|---|
| Re. 31,897 | 5/1985 | Johnson | 51/284 R |
| 3,353,307 | 11/1967 | Sarofeen | 51/216 LP |
| 3,704,558 | 12/1972 | Sarofeen | 51/277 |
| 3,996,701 | 12/1976 | Ramirez et al. | 51/216 LP |
| 4,089,102 | 5/1978 | Soper et al. | 51/216 LP |
| 4,358,913 | 11/1982 | Sorrells | 51/216 LP |
| 4,459,784 | 7/1984 | Hernandez et al. | 51/216 LP |
| 4,714,232 | 12/1987 | Blot | 51/216 LP |
| 4,925,518 | 5/1990 | Wasserman et al. | 51/216 LP |

*Primary Examiner*—Bruce M. Kisliuk
*Assistant Examiner*—Bryan Reichenbach
*Attorney, Agent, or Firm*—Bacon & Thomas

[57] ABSTRACT

A lens block for use in securing an optical lens during cutting, grinding and polishing of the lens is disclosed wherein the lens block is formed from a plastic material and includes various radially extending grooves for introducing an adhesive material between the lens block and a lens blank to be worked upon. The grooves also defined therebetween various ribs and upstanding surface portions which function to increase the surface area of the lens block for adhesion purposes and to provide additional structural rigidity to the lens block which prevents flexing of the block.

19 Claims, 2 Drawing Sheets

PLASTIC LENS BLOCK WITH RIBS

BACKGROUND OF THE INVENTION

1. Field of the Invention

The present invention generally pertains to the formation of optical lenses. Glass and/or plastic optical lenses are ground and cut from a limited number of standardized lens blanks. Depending upon an individual's prescription, each lens blank is ground and cut so that the optical qualities of the finished lens match the prescription required. By grinding, cutting and polishing, a limited number of lens blanks will produce large number of finished lenses.

In general, a lens is ground in a machine called a generator. The lens is held in the generator by a block that is attached to the lens via an adhesive substance. The lens block itself comes in various sizes with various inside curvatures to grind different lens materials (plastic or glass) to specified prescriptions.

More specifically, the present invention pertains to a unitary lens block for use in securing an optical lens during grinding, cutting and polishing of the lens by adhesively bonding a lens blank to the lens block.

2. Description of the Prior Art

When a lens blank is secured to a lens block and the block flexes during cutting, grinding or polishing of the lens, unwanted curves will be formed in the lens that make the lens optically worthless. Therefore, lens blocks must be made from rigid, non-flexing materials. U.S. Pat. No. Re. 31,897 describes a lens block that can be made from various rigid materials such as brass, steel, aluminum, zinc alloys and plastic.

Various problems have been encountered in the prior art when a metal lens block is utilized. First, a solder-like metal alloy has heretobefore been required to be used with metal blocks as the adhesive material. Such metal alloys are composed of heavy metals in different percentages. A typical composition example of such a metal alloy is: 45% bismuth, 23% lead, 19% indium, 8% tin and 5% cadmium. The different metals and percentages thereof give the alloy different melting points which become significant when holding either plastic or glass lens blanks. Higher melt point alloys are generally used to hold the heaver and harder to grind glass lens blanks. This high melt alloy, however, cannot be used with light plastic lenses since the higher melting point generally distorts the plastic lens. In addition, the composition of the metal alloy itself creates a problem. The Environmental Protection Agency has mandated that various of these materials be removed from federal optical labs by the middle of 1992 due to the toxicity of these metals.

Due to the problems associated with such metal alloy adhesive compositions, it has recently been proposed to utilize a wax as a replacement. Unfortunately, using a wax adhesive material does not work well with known metal blocks since the wax medium does not adhere well to the inside surface of the metal block.

The use of a plastic lens block, however, can be used with both alloy blocking and wax blocking if the plastic block remains rigid and if the blocking medium, alloy or wax, adheres to the block. Inherently, however, plastic blocks are less rigid than the prior known metal blocks and therefore have a greater tendency to flex during the cutting, grinding or polishing of a lens blank. Also, plastic blocks inherently adhere less well to wax or alloy.

Accordingly, there exists a need in the art for a plastic lens block that will remain structurally rigid during cutting, grinding or polishing of lens blanks such that the blocks will not flex and cause flaws in the optical lenses, and to which known blocking mediums will adhere properly and release from properly.

SUMMARY OF THE INVENTION

This invention relates to a plastic lens block which includes various radially extending grooves into which an adhesive material such as a metal alloy or wax can be introduced for securing a lens blank during cutting, grinding and polishing operations. In addition, the lens block of the present invention includes various rib portions and upstanding surface portions which function to increase the surface area onto which either the wax or alloy can adhere and to provide the plastic lens block with structural integrity which prevents distortion of the block during the cutting, grinding and polishing operations.

DETAILED DESCRIPTION OF A PREFERRED EMBODIMENT

Figure 4:
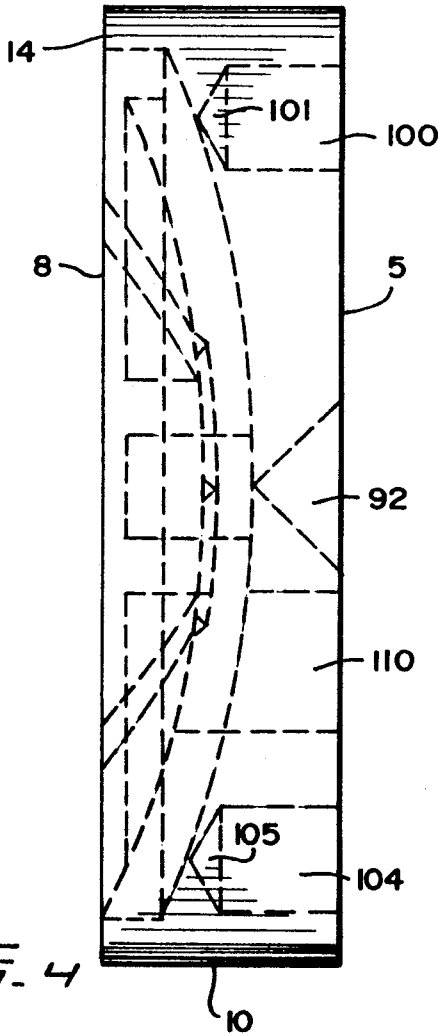
FIG. 4 is a side view of the lens block shown in FIG. 1.
Figure 1:
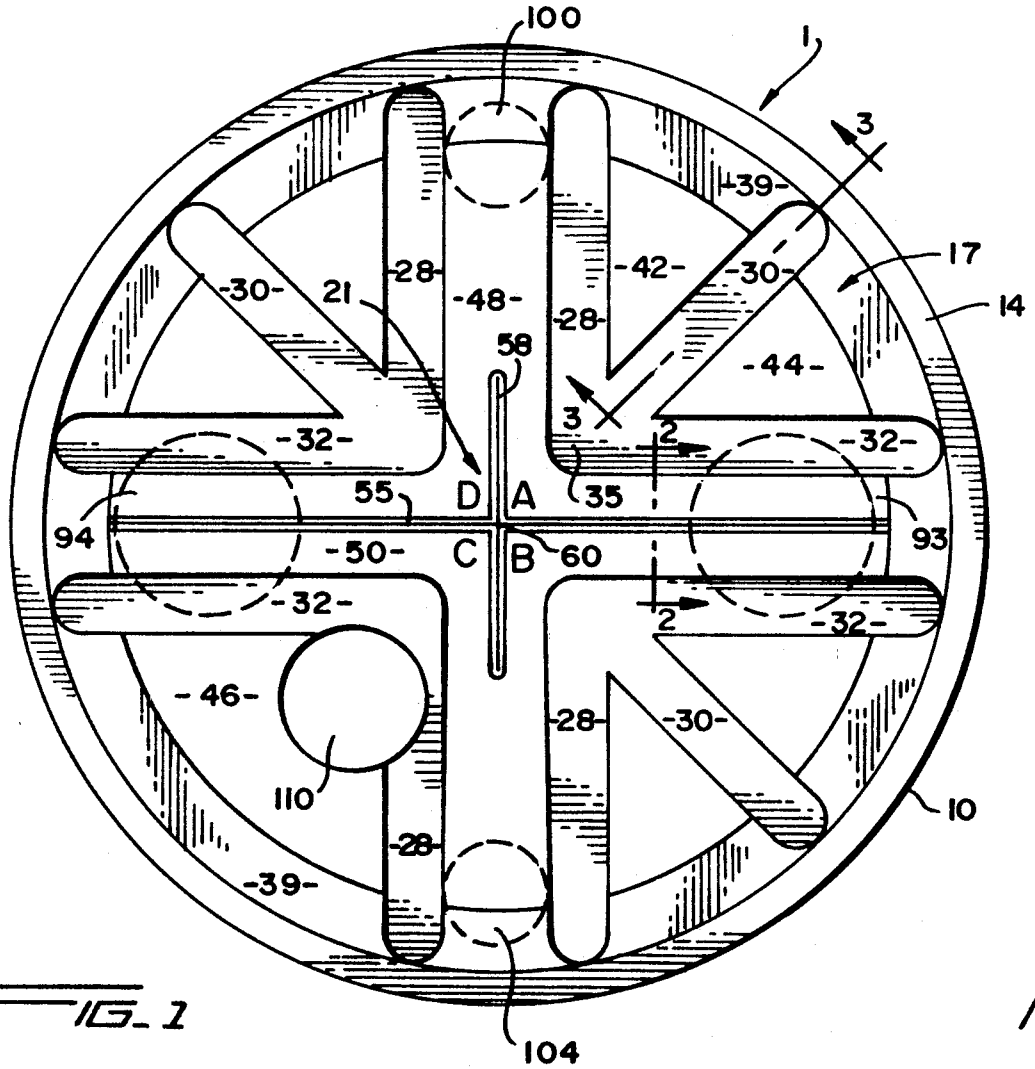
FIG. 1 is a top elevation view of a lens block according to the present invention.

With initial reference to FIGS. 1 and 4, the present invention is directed towards a lens block comprising a unitary block body generally indicated at 1 having a lower body mounting surface portion 5 and a upper lens mounting surface portion 8. Block body 1 takes a substantially disk-shaped form defined by an annular peripheral sidewall 10. In the preferred embodiment, block body 1 is formed of a plastic material. A suitable plastic material is, for example, a homopolymer polypropylene containing about 20% short glass fibers that are not chemically bonded to the plastic matrix. Such a block body can be used for both alloy blocking and wax blocking as will be discussed more fully below.

Lens mounting surface portion 8 is generally concave as shown best in FIG. 4 and is defined by an outer peripheral lip 14 of sidewall 10. Outer peripheral lip 14 extends about the entire outer edge of lens mounting surface portion 8 as clearly shown in FIGS. 1 and 4. With specific reference to FIG. 1, lens mounting surface portion 8 includes an outer peripheral portion 17 and a central portion 21. Lens mounting surface portion 8 is divided into four quadrants A, B, C, D with quadrants A, B and D being symmetrically configured. Therefore, in discussing these three quadrants, a detailed description of quadrant A will be given below and it is to be understood that quadrants B and D are symmetrically identical and like reference numerals have been used to indicate corresponding portions thereof.

Each quadrant A, B, D of lens mounting surface portion 8 includes a plurality of radially extending grooves 28, 30 and 32 which extend from outer peripheral portion 17 radially inward towards central portion 21. As depicted in FIG. 1, radial groove 28 extends longitudinally of lens mounting surface portion 8 and radial groove 32 extends transversely to radial groove 28. Therefore, radial groove 28 is substantially perpendicular to radial groove 32. Radial groove 30 bisects the angle formed between radial groove 28 and radial groove 32. As shown in FIG. 1, each radial groove 28, 30 and 32 terminates in a common nexus area 35 which is located radially outward from central portion 21.

By the above description it can readily be seen that radially extending grooves 28, 30 and 32 are interconnected at their radial inner ends through common nexus area 35. Radially extending grooves 28, 30 and 32 are also interconnected at their radial outer ends by means of an annular groove 39 which is located radially inward from outer peripheral lip 14 and extends around the entire inner periphery of outer peripheral lip 14. Between radially extending grooves 28 and 30 and annular groove 39 is an upstanding, substantially triangular shaped surface portion 42. A similarly arranged upstanding, substantially triangular shaped surface portion 45 is disposed between radially extending grooves 30 and 32 and annular groove 39. Upstanding, substantially triangular shaped surface portions 42 and 44 will be discussed more fully below.

At this point, it should be noted that quadrant C of lens mounting surface portion 8 is substantially identical to quadrants A, B and D except that no radial extending groove corresponding to radial extending groove 30 exist therein. Due to the lack of a corresponding radial extending groove 30, quadrant C includes an upstanding surface portion 46 which extends between radial grooves 28 and 32. One additional structural difference between quadrants A, B, D and quadrant C will be discussed more fully hereinafter.

Figure 2:
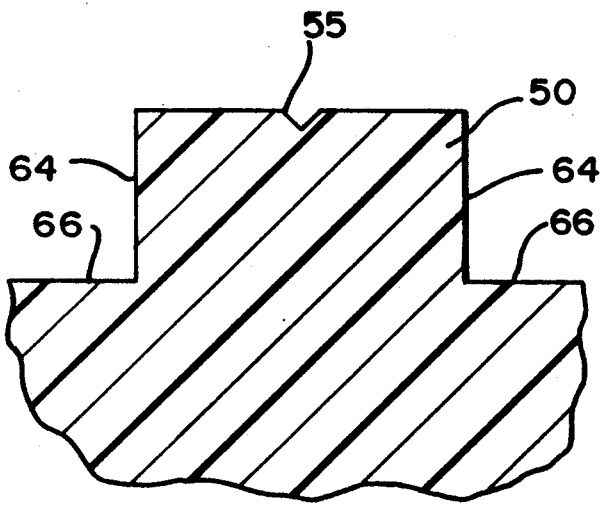
FIG. 2 is a cross-sectional view taken along lines 2—2 in FIG. 1.

Located between the longitudinally extending radial grooves 28 in quadrants A, D and quadrants B, C is a longitudinal rib 48. As shown in FIGS. 1 and 4, longitudinal rib 48 extends diametrically across lens mounting surface portion 8 and terminates at annular groove 39. In a similar manner, located between transverse extending grooves 32 of quadrants A, D and B, C is a transverse rib 50. Directly analogous to longitudinal rib 48, transverse rib 50 extends diametrically across lens mounting surface portion 8 and terminates at annular groove 39. As best shown in FIGS. 1 and 2, transverse rib 50 includes an elongated alignment recess 55 extending substantially across the entire length of transverse rib 50. Longitudinal rib 48 includes an analogous alignment recess 58 which extends perpendicular to elongated alignment recess 55 and intersects elongated alignment recess 55 at a center point 60 of unitary block body 1. Unlike elongated alignment recess 55, alignment recess 58 extends outwards from center point 60 for only a predetermined portion of the length of longitudinal rib 48. In general, alignment recesses 55 and 58 are provided to establish a visual central axis of unitary block body 1 for mounting a lens blank thereon and therefore their radial lengths are not deemed to be critical to the accomplishment of their function.

Reference will now be made to FIG. 2 which shows a cross-sectional view taken along line 2—2 in FIG. 1. FIG. 2 therefore depicts transverse rib 50 which is defined by rib sidewalls 64 extending up from base portion 66 of radially extending grooves 32 respectively located in quadrants A and B. As shown, elongated alignment recess 55 is substantially V-shaped and is centrally located with respect to top surface 67 of transverse rib 50.

Figure 3:
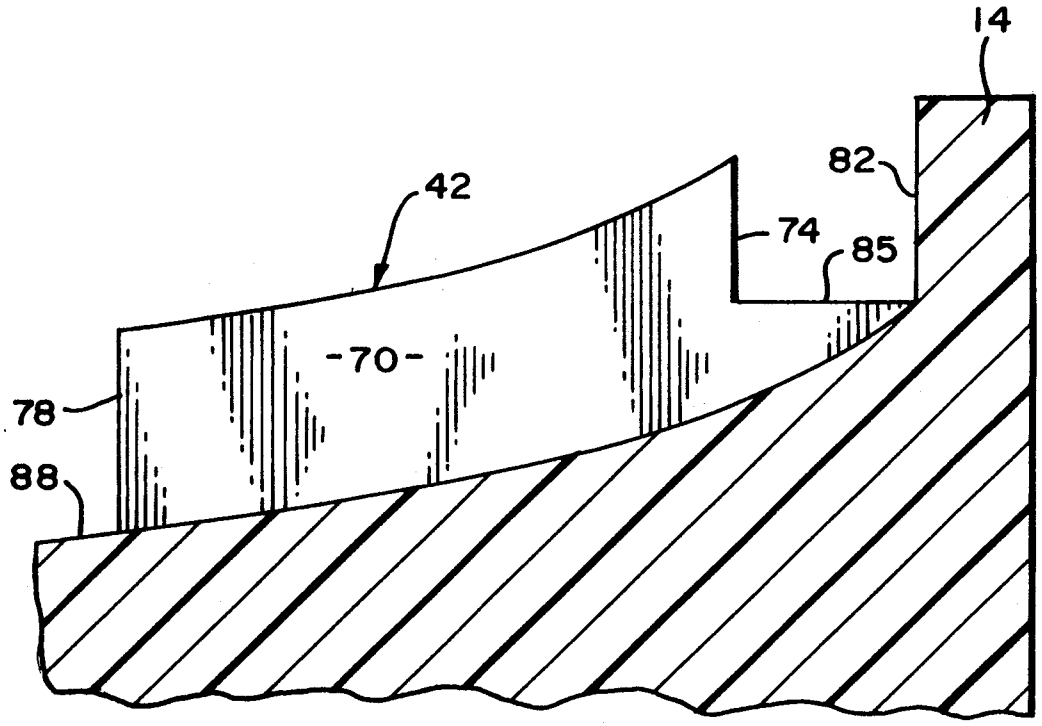
FIG. 3 is a cross-sectional view taken along lines 3—3 in FIG. 1.

Specific reference will now be made to FIG. 3 which shows a cross-sectional view taken along line 3—3 in FIG. 1. This sectional view is therefore taken substantially through the center of radially extending groove 30 which itself is defined between sidewall 70 of upstanding, substantially triangular shape surface portion 42 and the sidewall (not shown) of upstanding, substantially triangular shaped surface portion 44. Triangular shaped surface portion 42 includes a radial outer upstanding wall 74 and a radial inner upstanding wall 78. Annular groove 39 is defined by radial outer upstanding wall 74, inner sidewall 82 of outer peripheral lip 14 and base surface portion 85. Radially inner upstanding wall 78 of triangular shaped surface portion 42 defines the juncture between radial extending grooves 28 and 30, and along with base portion 88, aids in defining common nexus area 35.

At this point it should be noted that the depths of radially extending grooves 28, 30, 32 are defined by the height of rib sidewalls 64, upstanding wall 78 and sidewall 82. Therefore, these depths can be varied depending upon various factors such as the type of lens blank being worked on or the type of adhesive being used.

Reference will now be made again to FIGS. 1 and 4 in describing body mounting surface portion 5 of unitary block body 1. Body mounting surface portion 5 includes both centering and alignment structure for use in centering unitary block body 1 through the use of a plurality of probes (not shown) and for properly aligning block body 1 relative to the lens processing machine or generator (not illustrated) as is known in the art. The centering structure includes a plurality of inverted conically shaped indentations 92, 93 and 94 which are linearly arranged and transversely spaced along elongated alignment recess 55. For the purposes of clarity of the figures, central inverted conically shaped indentation 92 is not depicted in FIG. 1 but is clearly indicated in FIG. 4. The alignment structure includes a first cylindrical bore 100 having a conical end 101 and a second cylindrical bore 104 having a conical end 105. First cylindrical bore 100 and second cylindrical bore 104 are longitudinally spaced below longitudinal 48 and are substantially centered along alignment recess 58. Since the use of both centering and alignment structures analogous to those discussed above are widely known in the art, no further details thereof are provided.

Located in quadrant C of unitary block body 1 is an axial bore which extends from body mounting surface portion 5 through unitary block body 1 to lens mounting surface portion 8. Bore 110 opens up into both radial extending grooves 28 and 32 within quadrant C. Bore 110 is utilized for the insertion of an adhesive between lens mounting surface portion 8 and a corresponding lens blank in order to secure the lens blank to block body 1 during the grinding, cutting and/or polishing phases thereof. Since bore 110 opens into both radially extending grooves 28 and 30 in quadrant C, any adhesive forced through bore 110 from the side of body mounting surface portion 5 will fill radially extending grooves 28, 32 and will be progressively forced radially outward toward annular groove 39. Since annular groove 39 extends about the entire block body 1 as defined by sidewall 82 of outer peripheral lip 14, the introduction of the adhesive through bore 110 will eventually lead to the filling of annular groove 39 along with all the radially extending grooves 28, 30 and 32 in each of quadrants A, B, C and D.

Eventually, the adhesive will be forced over triangular shaped surface portions 42 and 44, upstanding surface portion 46, longitudinal rib 48 and transverse rib 50. Due to the presence of each of these surface portions and the sidewalls associated therewith, the surface area onto which the adhesive can adhere is increased. In addition, these surface portions provide added structural rigidity which prevents distortion of unitary block body 1 during the grinding, cutting and polishing operations. A rigid non-flexing block body is critical since any flexing will cause a defect in the optical lens being operated upon. The presence of these surface portions are even more critical due to the fact that unitary block body 1 is made from a plastic material which is inherently less rigid than the prior art metal blocks. It has been found, however, that by the use of the longitudinal and transverse ribs 48, 50, along with the upstanding surface portions 42, 44 and 46, the plastic unitary block body 1 of the present invention can maintain its structural rigidity throughout all of the operating phases.

In addition, since unitary block body 1 is made of plastic, various benefits can be taken advantage of. For instance, the plastic block of the present invention can be used with both alloy and wax adhesives. Another advantage of the plastic block is that the adhesive can be more readily removed from both the lens and the block body due to an inherent non-stick attribute of the block material. It has also been found that simply rinsing the block in hot water after completion of the finished lens removes any adhesive material left in block body 1. Furthermore, a plastic unitary block body will not rust and has been shown to withstanding the mechanical and chemical environments present in optical labs.

Although described with respect to a particular embodiment of the invention, it is to be understood that various changes and/or modifications can be made to the present invention without departing from the spirit and scope of the present invention as defined by the following claims.

I claim:

1. A lens block for use in securing an optical lens during cutting, grinding and polishing of the lens, said lens block comprising:

a unitary block body having a body mounting surface portion, an opposing lens mounting surface portion and a side portion spacing said body mounting surface portion from said lens mounting surface portion, said body mounting surface portion being spaced from said lens mounting surface portion in an axial direction;

a plurality of spaced, radially extending grooves formed in said lens mounting surface portion;

at least one additional groove formed in said lens mounting surface portion, said at least one additional groove interconnecting a predetermined number of said plurality of radially extending grooves;

an axial bore hole extending from said body mounting surface portion to said lens mounting surface portion and opening into at least one of said plurality of radially extending grooves.

2. A lens block as claimed in claim 1, further comprising a plurality of upstanding surface portions defined by and between said plurality of spaced, radially extending grooves.

3. A lens block as claimed in claim 2, wherein said lens mounting surface portion is defined by a plurality of substantially symmetrical quadrants, each of said quadrants including a respective set of said plurality of radially extending grooves.

4. A lens block as claimed in claim 3, wherein said lens mounting surface portion further comprises upstanding ribs defined between said quadrants.

5. A lens block as claimed in claim 1, wherein said lens block is formed from a plastic material.

6. A lens block as claimed in claim 1, wherein said at least one additional groove is annular.

7. A lens block as claimed in claim 6, wherein said at least one additional groove is formed in said lens mounting surface portion adjacent the periphery thereof.

8. A lens block as claimed in claim 1, wherein said lens mounting surface portion is concave.

9. A lens block as claimed in claim 1, wherein said body mounting surface portion includes means for aligning and securing said lens block during the cutting, grinding and polishing operations.

10. A lens block for use in securing an optical lens during cutting, grinding and polishing of the lens, block comprising a unitary block body having a body mounting surface portion and an opposing lens mounting surface portion including a central portion and a radially spaced outer peripheral portion, said lens mounting surface portion further including a plurality of spaced grooves extending radially from adjacent said outer peripheral portion toward said central portion, said plurality of grooves terminating radially outward from said central portion.

11. A lens block as claimed in claim 10, further comprising at least one additional groove formed in said lens mounting surface portion, said at least one additional groove interconnecting a predetermined number of said plurality of radial grooves.

12. A lens block as claimed in claim 11, wherein said at least one additional groove is annular and is formed in said lens mounting surface portion in said outer peripheral portion thereof.

13. A lens block as claimed in claim 10, wherein said lens mounting surface portion is concave.

14. A lens block as claimed in claim 10, wherein said lens block is formed from a plastic material.

15. A lens block as claimed in claim 10, further including means for supplying an adhesive to said plurality of grooves for use in securing the lens being worked upon to said lens block.

16. A lens block as claimed in claim 10, further comprising a plurality of upstanding surface portions defined by and between said plurality of spaced, radially extending grooves.

17. A lens block as claimed in claim 16, wherein said lens mounting surface portion is defined by a plurality of substantially symmetrical quadrants, each of said quadrants including a respective set of said plurality of radially extending grooves.

18. A lens block as claimed in claim 17, wherein said lens mounting surface portion further comprises upstanding ribs defined between said quadrants.

19. A lens block as claimed in claim 18, wherein said plurality of radially extending grooves in each quadrant are angularly spaced from one another and converge to a common nexus area adjacent said central portion.

* * * * *